US006987938B2

(12) United States Patent
Murakami et al.

(10) Patent No.: US 6,987,938 B2
(45) Date of Patent: Jan. 17, 2006

(54) PROCESS CARTRIDGE AND IMAGE FORMING APPARATUS

(75) Inventors: Ryuta Murakami, Shizuoka (JP); Kazushi Watanabe, Shizuoka (JP); Toshiyuki Karakama, Shizuoka (JP)

(73) Assignee: Canon Kabushiki Kaisha, Tokyo (JP)

( * ) Notice: Subject to any disclaimer, the term of this patent is extended or adjusted under 35 U.S.C. 154(b) by 45 days.

(21) Appl. No.: 10/743,406

(22) Filed: Dec. 23, 2003

(65) Prior Publication Data

US 2004/0190933 A1 Sep. 30, 2004

(30) Foreign Application Priority Data

Dec. 26, 2002 (JP) ..... 2002-377109

(51) Int. Cl.
*G03G 21/16* (2006.01)

(52) U.S. Cl. ..... 399/111; 399/109; 399/358; 399/360

(58) Field of Classification Search ..... 399/107, 399/109, 111, 119, 120, 123, 343, 358, 359, 399/360

See application file for complete search history.

(56) References Cited

U.S. PATENT DOCUMENTS

| | | | | |
|---|---|---|---|---|
| 5,294,960 | A | 3/1994 | Nomura et al. | 355/210 |
| 5,331,372 | A | 7/1994 | Tsuda et al. | 355/200 |
| 5,345,294 | A | 9/1994 | Nomura et al. | 355/200 |
| 5,404,198 | A | 4/1995 | Noda et al. | 355/200 |
| 5,455,665 | A | 10/1995 | Baba et al. | 355/298 |
| 5,510,878 | A | 4/1996 | Noda et al. | 355/211 |
| 5,583,613 | A | 12/1996 | Kobayashi et al. | 355/200 |
| 5,623,328 | A | 4/1997 | Tsuda et al. | 399/111 |
| 5,669,042 | A | 9/1997 | Kobayashi et al. | 399/111 |
| 5,689,774 | A | 11/1997 | Shishido et al. | 399/111 |
| 5,790,923 | A | 8/1998 | Oguma et al. | 399/106 |
| 5,794,101 | A | 8/1998 | Watanabe et al. | 399/103 |
| 5,809,374 | A | 9/1998 | Tsuda et al. | 399/111 |
| 5,828,928 | A | 10/1998 | Sasago et al. | 399/111 |
| 5,884,124 | A | 3/1999 | Karakama et al. | 399/123 |
| 5,890,036 | A | 3/1999 | Karakama et al. | 399/119 |
| 5,899,602 | A | 5/1999 | Noda et al. | 399/111 |
| 5,903,803 | A | 5/1999 | Kawai et al. | 399/116 |
| 5,943,528 | A | 8/1999 | Akutsu et al. | 399/110 |
| 5,966,568 | A | 10/1999 | Numagami et al. | 399/111 |
| 6,032,007 | A | 2/2000 | Yamaji et al. | 399/104 |
| 6,070,028 | A | 5/2000 | Odagawa et al. | 399/104 |
| 6,144,398 | A | 11/2000 | Yokoyama et al. | 347/263 |
| 6,160,976 | A | 12/2000 | Karakama et al. | 399/104 |
| 6,163,665 | A | 12/2000 | Watanabe et al. | 399/111 |
| 6,169,866 | B1 | 1/2001 | Watanabe et al. | 399/111 |
| 6,266,500 | B1 | 7/2001 | Numagami et al. | 399/104 |
| 6,397,017 | B1 | 5/2002 | Sakai et al. | 399/27 |
| 6,463,223 | B1 | 10/2002 | Karakama et al. | 399/27 |

(Continued)

*Primary Examiner*—Hoang Ngo
(74) *Attorney, Agent, or Firm*—Fitzpatrick, Cella, Harper & Scinto

(57) ABSTRACT

Provided are a process cartridge and an image forming apparatus having the process cartridge. The process cartridge is constituted as one of at least two types of cartridges, a first cartridge and a second cartridge, and used selectively by being made detachably attachable to a main body of an identical image forming apparatus. The first cartridge includes: a cleaning unit which removes toner remaining on a surface of a medium; a cleaning frame which receives toner recovered by the cleaning unit and has an opening; and a waste toner carrying unit which is provided in the opening and carries the toner in the cleaning frame. The second cartridge includes: a cleaning unit which removes toner remaining on a surface of a medium; a cleaning frame which receives toner recovered by the cleaning unit and has an opening; and a sealing member which seals the opening without the waste toner carrying unit being provided in the opening.

38 Claims, 7 Drawing Sheets

U.S. PATENT DOCUMENTS

| | | | | |
|---|---|---|---|---|
| 6,571,070 | B2 | | 5/2003 | Oguma et al. ..... 399/27 |
| 6,625,413 | B2 | | 9/2003 | Oguma et al. ..... 399/222 |
| 6,654,567 | B2 | | 11/2003 | Karakama et al. ..... 399/25 |
| 6,654,577 | B1 | * | 11/2003 | Hooper ..... 399/109 |
| 2002/0012542 | A1 | | 1/2002 | Karakama et al. ..... 399/27 |
| 2002/0021908 | A1 | | 2/2002 | Matsumoto et al. ..... 399/27 |
| 2002/0131789 | A1 | | 9/2002 | Yokoi et al. ..... 399/103 |
| 2002/0172521 | A1 | | 11/2002 | Oguma et al. ..... 399/27 |
| 2003/0156869 | A1 | | 8/2003 | Karakama et al. ..... 399/350 |
| 2003/0161657 | A1 | | 8/2003 | Yokoi et al. ..... 399/119 |
| 2003/0215261 | A1 | | 11/2003 | Karakama et al. ..... 399/111 |

* cited by examiner

PROCESS CARTRIDGE AND IMAGE FORMING APPARATUS

BACKGROUND OF THE INVENTION

1. Field of the Invention

The present invention relates to a process cartridge which includes cleaning means for removing toner used for image formation by an electrophotographic process, and to an image forming apparatus.

2. Related Background Art

Conventionally, an image forming apparatus using an electrophotographic image forming process adopts a process cartridge system. In the process cartridge system, an electrophotographic photosensitive member and process means acting on the electrophotographic photosensitive member are integrated into a cartridge which is provided detachably attachable to a main body of the electrophotographic image forming apparatus. According to this process cartridge system, a user of the image forming apparatus can perform maintenance of the apparatus independently without relying upon a serviceman. Thus, operability can be improved remarkably. Such a process cartridge system is widely used in the field of the electrophotographic image forming apparatus.

In addition, a single process cartridge is often selected for an image forming apparatus, in which case a large cleaning frame is used. Even in the case in which plural kinds of process cartridges can be selected, a cleaning frame is enlarged as an amount of toner is increased. The enlarged cleaning frame is also adopted even if the amount of toner is small.

However, when it is attempted to increase a capacity for containing toner, not only a toner frame of a large capacity process cartridge but also a cleaning frame has to be enlarged. In accordance with the increase in the size of the cleaning frame, the process cartridge is enlarged. Moreover, a size of an image forming apparatus main body is also increased in order to receive the enlarged process cartridge.

In addition, in the case in which a cartridge of a small capacity type with a small amount of toner is set for the enlarged cartridge, even if the cleaning frame still has room in its capacity for receiving the toner, the cleaning frame has to be replaced once the toner contained in the toner frame is fully consumed. Thus, for a user who performs a large quantity of image formation, the number of times of cartridge replacement increases. On the other hand, for a user who performs a small quantity of image formation, the large capacity process cartridge is expensive, and the user continues to use one process cartridge for a long period of time. Thus, image degradation or the like is liable to occur.

SUMMARY OF THE INVENTION

It is an object of the present invention to provide a cleaning device of two types, namely, a first cleaning device provided with carrying means for carrying toner to a cleaning frame and a second cleaning device not provided with the carrying means, each being detachably attachable to an identical apparatus, to thereby allow a user to select a cleaning device of a long life or a low price depending on usage.

In addition, it is another object of the present invention to provide a process cartridge of two types, namely, a first process cartridge using a first cleaning frame provided with carrying means for carrying toner to a cleaning frame and a second process cartridge using a second cleaning frame not provided with the carrying means, each being detachably attachable to an identical apparatus, to thereby allow a user to select a process cartridge of a long life or a low price depending on usage.

In order to attain the above-mentioned objects, the present invention provides a process cartridge and an image forming apparatus, the process cartridge including: an image bearing member; developing means; a toner frame which contains toner to be supplied to the image bearing member; cleaning means which removes toner remaining on the image bearing member; and a cleaning frame which receives the toner on the image bearing member recovered by the cleaning means, an opening being formed in the cleaning frame. The process cartridge and the image forming apparatus are characterized in that at least one of a first cleaning device, which is provided with waste toner carrying means for carrying the toner of the cleaning frame in the opening and a second cleaning device, which is not provided with the waste toner carrying means but is provided with a sealing member in the opening, is constituted, and the process cartridge provided with the first cleaning device and the process cartridge provided with the second cleaning device are each detachably attachable to a main body of an identical image forming apparatus.

DESCRIPTION OF THE PREFERRED EMBODIMENTS

Figure 1:
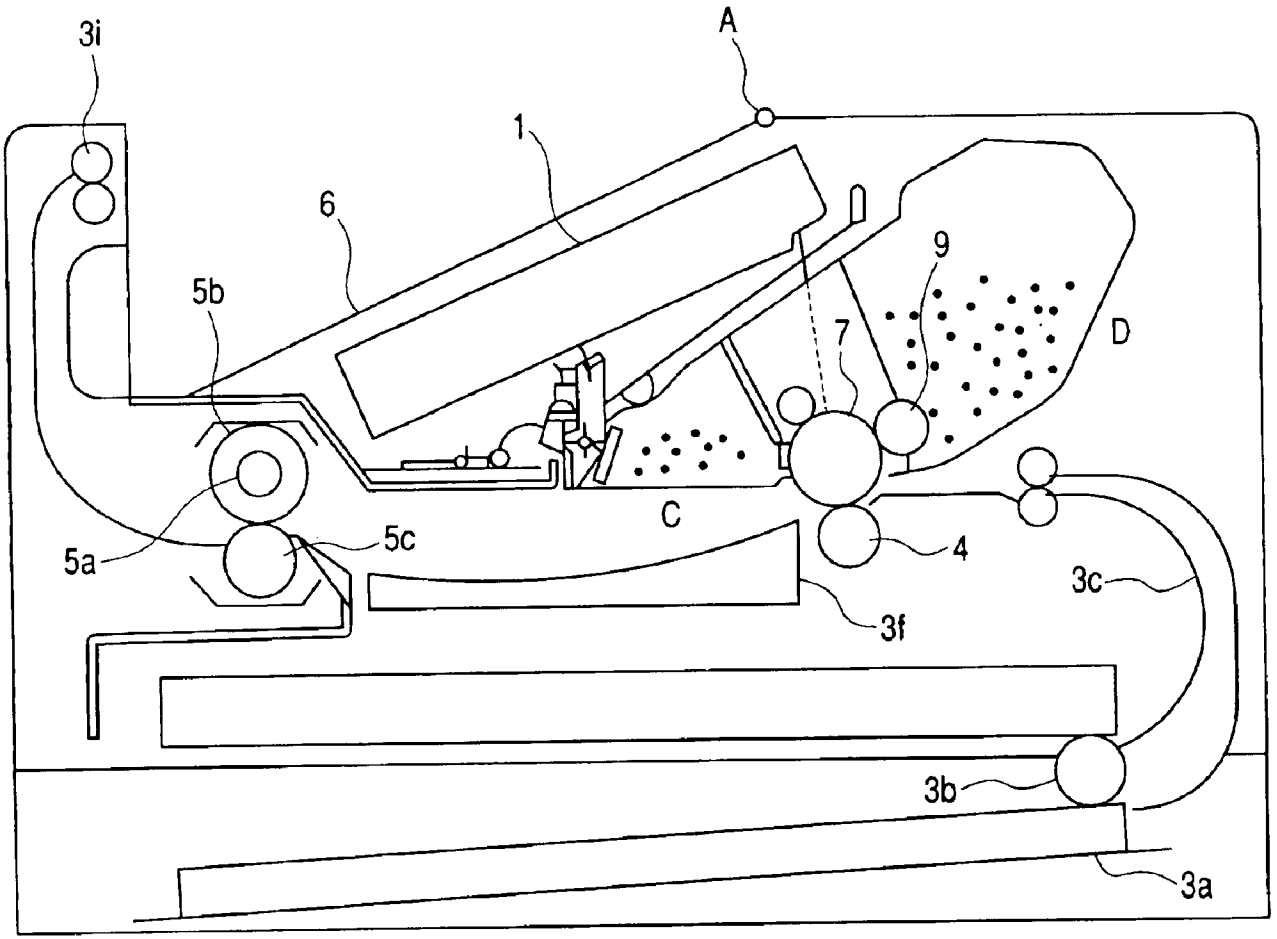
FIG. 1 is a side view showing an embodiment of an electrophotographic image forming apparatus according to the present invention.
Figure 2:
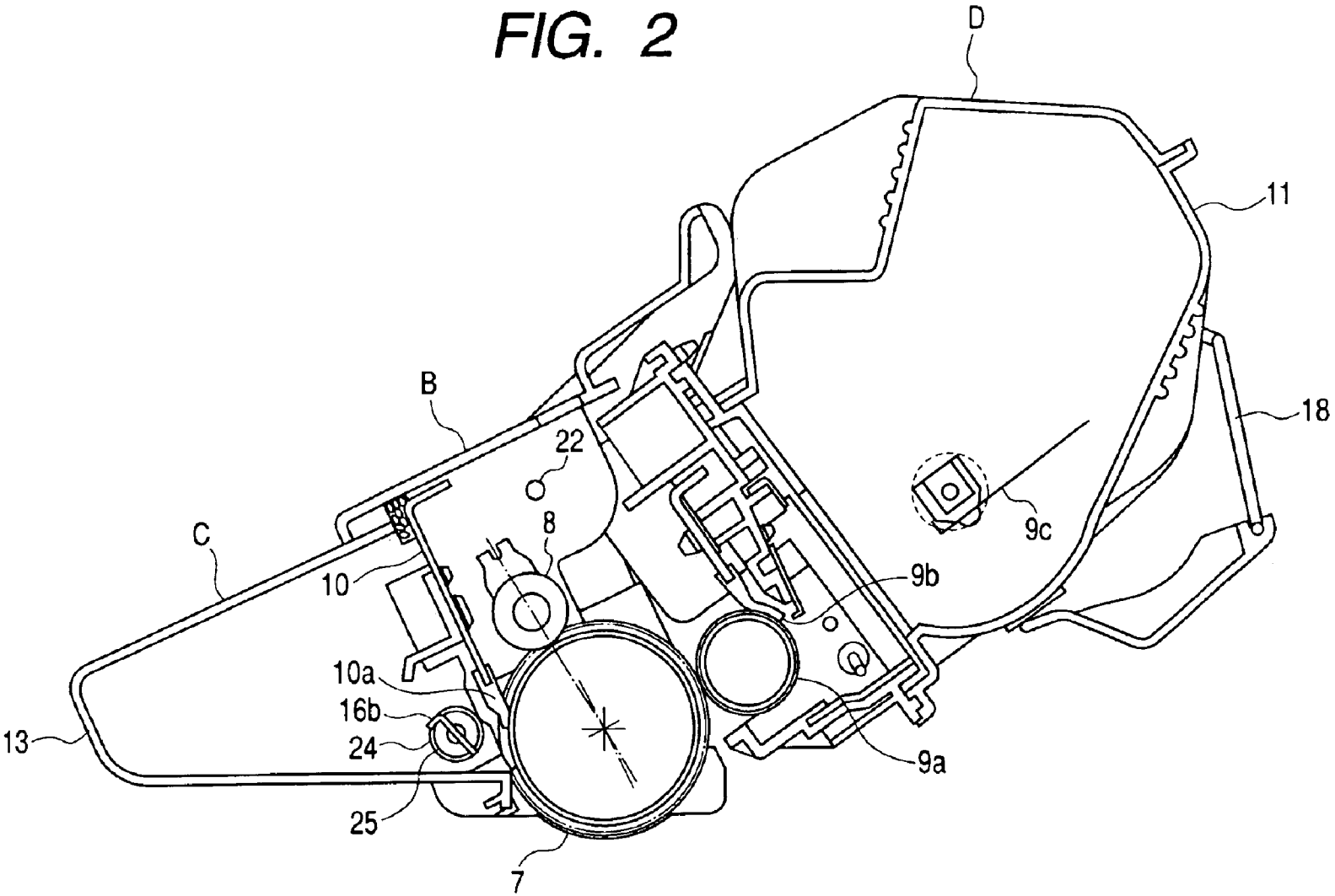
FIG. 2 is a side sectional view showing an embodiment of a process cartridge according to the present invention.

First, an embodiment of an image forming apparatus (laser beam printer) to which the present invention is applied will be described with reference to FIG. 1.

An image forming apparatus A forms an image on a recording medium (e.g., recording paper, an OHP sheet, or cloth) with an electrophotographic image forming process.

A predetermined voltage is applied to a charging roller 8, which is in contact with an electrophotographic photosensitive member of a drum shape (hereinafter referred to as "photosensitive drum") 7, to uniformly charge the photosensitive drum 7, and the photosensitive drum 7 is exposed to light using an exposure device 1, which uses a laser beam source or the like, to form a latent image thereon. Toner contained in a toner frame 11 is deposited on a portion of the photosensitive drum 7, where the latent image is formed, by developing means 9 to form a toner image.

On the other hand, in synchronization with the formation of the toner image, a recording medium 2 set in a sheet feeding cassette 3*a* is conveyed by a pickup roller 3*b* and a conveyance guide 3*c*. Timing for appropriately transferring the toner image on the photosensitive drum 7 to the recording medium 2 is taken by registration rollers 3, and the recording medium 2 is conveyed to a transfer roller 4 at appropriate timing. The toner image formed on the photosensitive drum 7 provided in a process cartridge B is transferred to the recording medium 2 by applying a voltage to the transfer roller 4 serving as transfer means.

Thereafter, the recording medium 2, to which the toner image has been transferred, is conveyed to fixing means 5 by a conveyance guide 3*f*. This fixing means 5 has a drive roller 5*c* and a fixing roller 5*b* incorporating a heater 5*a*. The fixing means 5 applies heat and pressure to the recording medium 2, which passes through the fixing means 5, to fix the transferred toner image. Then, the recording medium 2 is conveyed by a discharge roller pair 3*i* to be discharged to a discharge tray 6.

(First Embodiment)

Next, the process cartridge B will be described.

FIGS. 2 to 5 show the process cartridge B including waste toner carrying means for forcibly carrying waste toner, which is removed from the photosensitive drum 7 by a cleaning blade 10*a*, into a cleaning frame 13.

A laser beam corresponding to image information from an optical system 1 irradiates the photosensitive drum 7 via an exposure opening 1*e* to form a latent image.

Toner in a toner container 11 is carried to a developing roller 9*a* by rotation of a toner carrying member 9*c*. Then, the developing roller 9*a* incorporating a fixed magnet is rotated, while a toner layer is formed on a surface of the developing roller 9*a*. The toner layer is given a triboelectric charge by a development blade 9*b* that regulates an amount of toner on a circumferential surface of the developing roller 9*a* and gives a triboelectric charge. Such toner is supplied to a development area of the photosensitive drum 7. Then, the toner is transferred to the photosensitive drum 7 in correspondence with the latent image to thereby visualize the toner image.

Subsequently, a voltage of a polarity opposite to that of the toner image is applied to the transfer roller 4 to transfer the toner image formed on the photosensitive drum 7 to the recording medium 2, and then waste toner remaining on the photosensitive drum 7 is removed by the cleaning blade 10*a* which is attached to a support member. Then, the removed waste toner is recovered in the cleaning frame 13.

Figure 3:
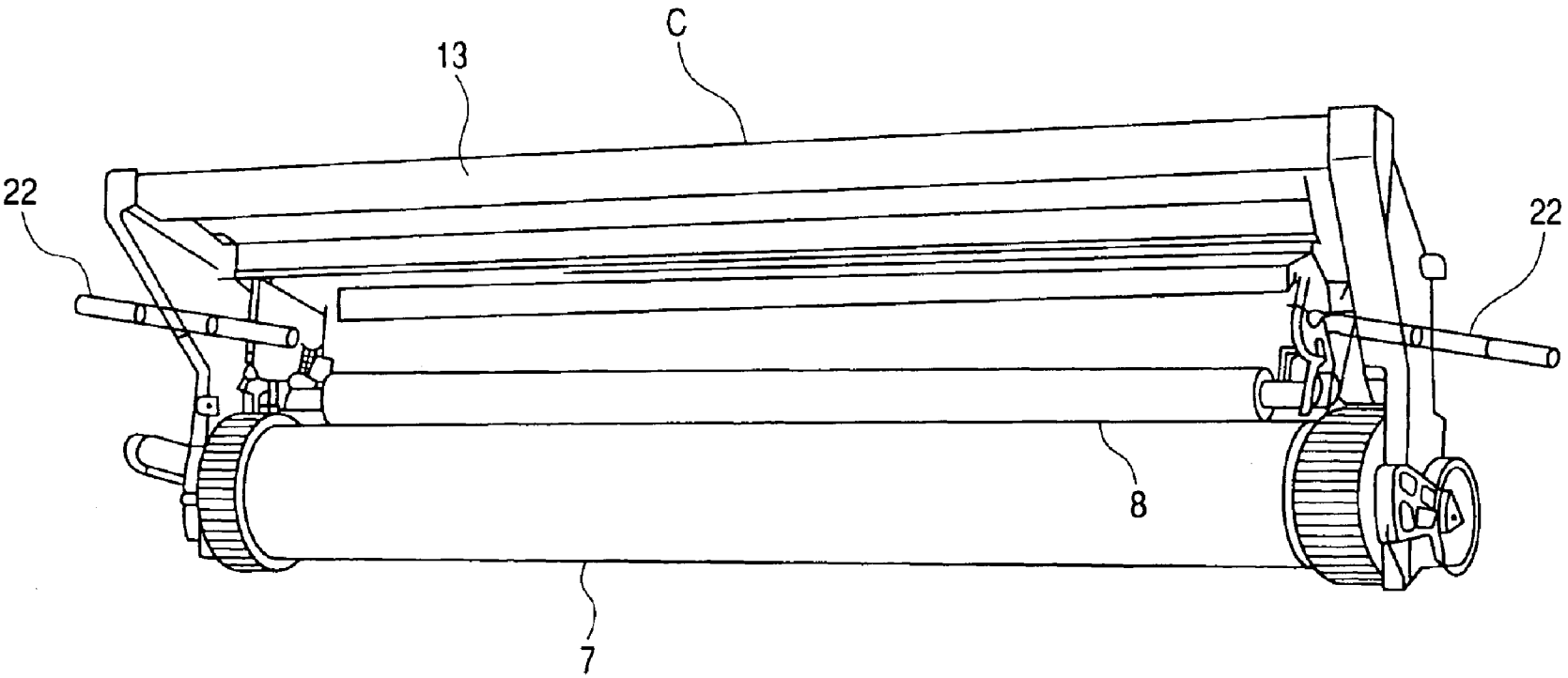
FIG. 3 is a perspective view showing an embodiment of a cleaning unit according to the present invention.

In addition, FIG. 3 shows a perspective view of a cleaning unit C of the process cartridge. The cleaning unit C includes the photosensitive drum 7, cleaning means 10 including the cleaning blade 10*a*, and the cleaning frame 13 mounted with the cleaning means 10 and the charging roller 8. The cleaning unit C is rotatably coupled with a development unit D, which holds the toner frame 11 having a toner containing portion for containing toner and developing means such as the developing roller 9*a*, using a coupling member 22, whereby the process cartridge B is constituted. Further, the process cartridge B is removably mounted to cartridge mounting means provided in a main body of the image forming apparatus.

Note that a drum shutter member (not shown) is attached to the main body of the image forming apparatus so as to cover the photosensitive drum 7 for the purpose of preventing exposure to light for a long time period, contact with a foreign matter, and the like when the process cartridge B is removed from the main body of the image forming apparatus.

Next, a detailed structure of a first cleaning unit C of this embodiment will be described.

Figure 4:
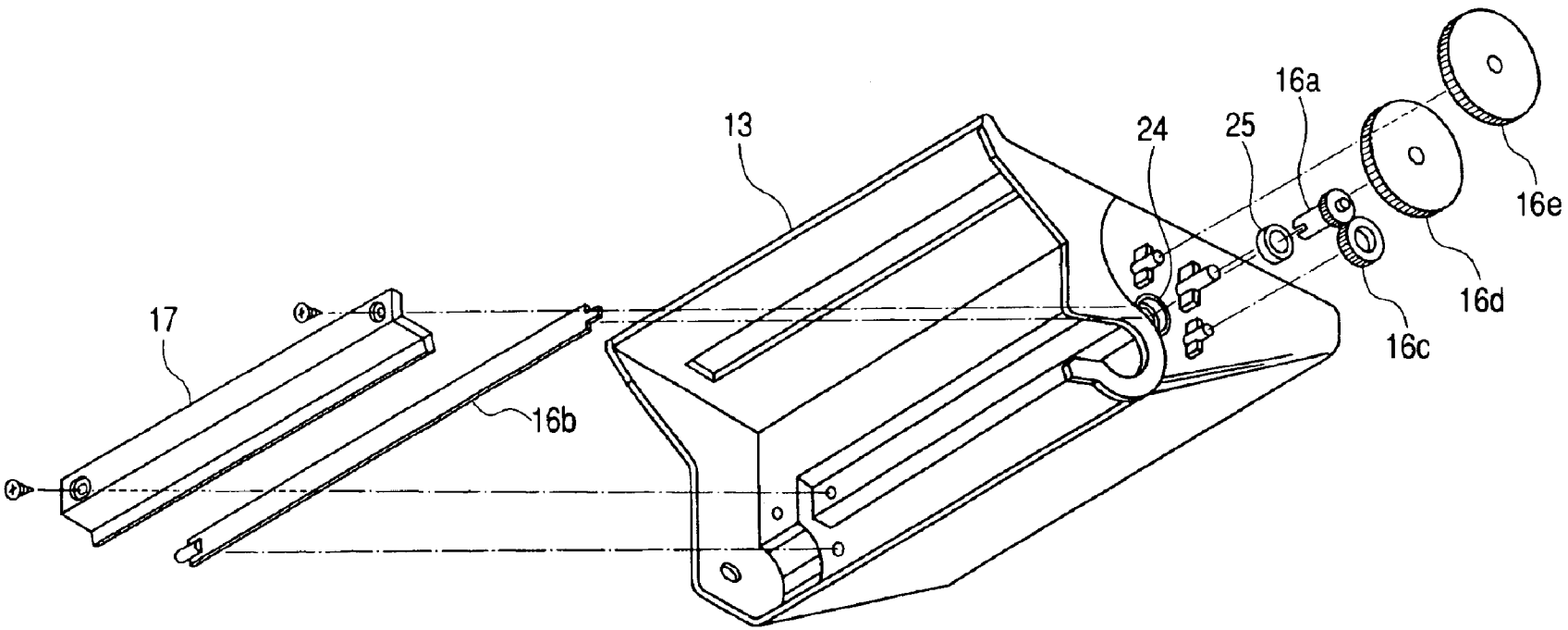
FIG. 4 is a perspective view showing a positional relation among waste toner carrying means, driving means, and a partition member according to the present invention.
Figure 5:
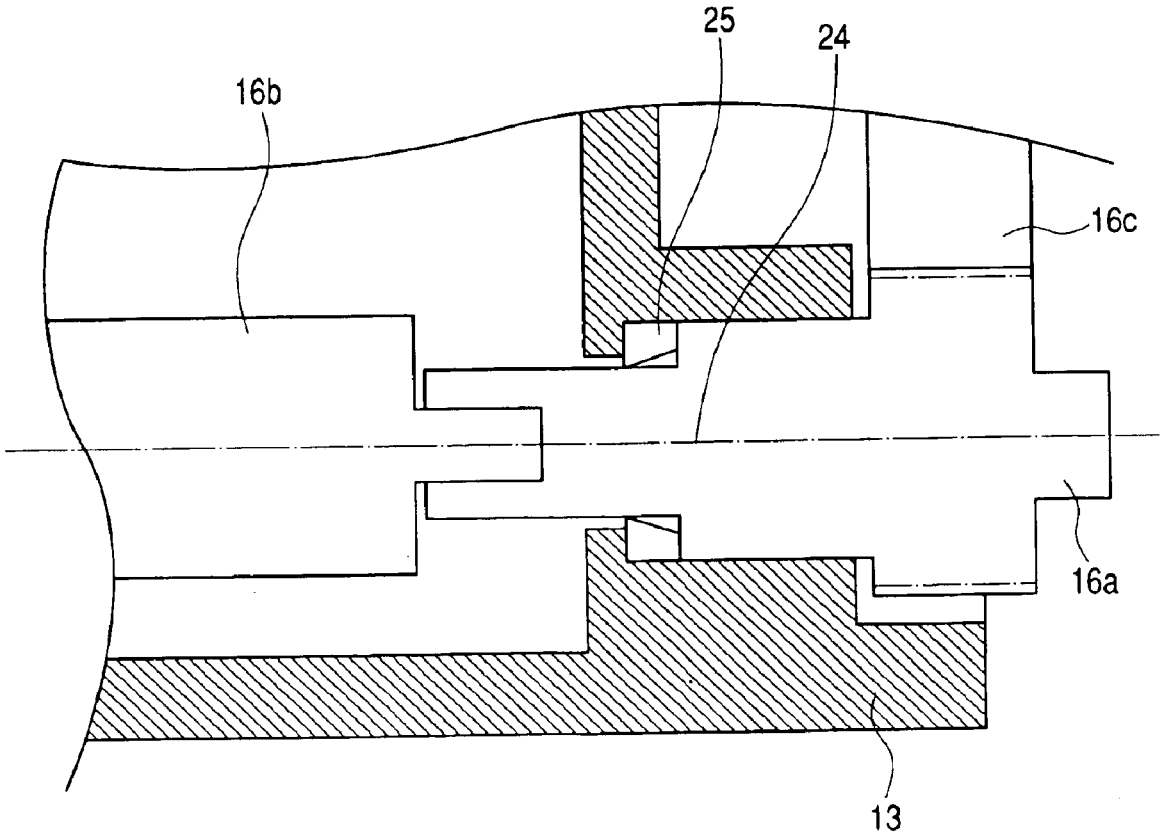
FIG. 5 is a sectional view showing engagement of a waste toner carrying member and a drive member according to the present invention.

FIG. 4 shows a detail view of waste toner carrying means provided in the cleaning frame 13 of the process cartridge B. FIG. 5 shows an enlarged view of a drive portion of the waste toner carrying means. The cleaning frame 13 has a through hole 24, which serves as an opening for setting the waste toner carrying means, in a longitudinal direction thereof. The waste toner carrying means includes a waste toner carrying member 16*b* and a drive member 16*a* serving as a driving force receiving member for driving the waste toner carrying member 16*b*. This waste toner carrying member 16*b* rotates to forcibly carry waste toner to the cleaning frame 13. In addition, the driving force of the waste toner carrying member 16*b* is transmitted from a drum gear crimped to the photosensitive drum 7 while being decelerated via idler gears 16*c*, 16*d*, and 16*e*. The drive member 16*a* is attached to an end face in a longitudinal direction of the process cartridge B while being pierced through the through-hole 24 provided on a side of the cleaning frame 13 from an outside to an inside of the cleaning frame 13. Further, a seal member 25 such as an oil seal is provided in the through-hole 24.

Note that a partition plate 17 acting as eaves is attached above the waste toner carrying member 16*b* so as to prevent the waste toner carried by the waste toner carrying member 16*b* from falling on the waste toner carrying member 16*b* to cause a drive failure due to adhesion of toner.

Next, an operation for carrying waste toner into the cleaning frame 13 with the waste toner carrying means will be described in detail. After image formation, waste toner remaining on the photosensitive drum 7 is removed by the cleaning blade 10*a* which is in abutment against the photosensitive drum 7. The removed waste toner is gradually accumulated in the cleaning frame 13 but is liable to be recovered in the vicinity of a lower part of the cleaning blade 10*a*. Thus, the waste toner recovered in the vicinity of the lower part of the cleaning blade 10*a* is forcibly carried in a downstream direction of the cleaning frame 13 by the rotation of the waste toner carrying member 16*b*. The waste toner forcibly carried into the cleaning frame 13 is deposited in a vertical downward direction in the cleaning frame 13. However, since the waste toner is in a state in which a bulk density thereof is increased, an amount of the waste toner to be received in the cleaning frame 13 can be made larger than an amount of waste toner to be received in a cleaning frame of the same volume.

A portion of the waste toner forcibly carried into the cleaning frame 13 is carried in a direction of the waste toner carrying means again by a circulating flow generated in the cleaning frame 13 by the toner carrying operation. When the circulated waste toner is deposited on the waste toner carrying member 16*b*, a driving force of the waste toner carrying member 16*b* is increased to cause an increase in load with respect to a drive source (not shown). Thus, in order to prevent the circulated waste toner from depositing on the waste toner carrying member 16*b*, the partition member 17 is provided above the waste toner carrying member 16*b* such that the circulated waste toner is deposited on the downstream side in the toner carrying direction.

In addition, a drive source for giving a driving force to the drive member 16*a* from the main body of the image forming apparatus is the same as the drive source giving a driving force to the photosensitive drum 7. When the waste toner removed by the cleaning blade 10*a* is carried into the cleaning frame 13, fluctuation in torque may occur with respect to the drive source, causing driving fluctuation with respect to the photosensitive drum 7. Thus, an image failure due to the fluctuation in torque can be prevented by adopting a torque limiter or the like such that a driving torque transmitted from the drive source to the photosensitive drum 7 is always fixed at the time of image formation.

With the above-mentioned structure, by using the waste toner carrying member 16*b*, it is possible to increase a bulk density of the waste toner in the cleaning frame 13 and forcibly carry the waste toner to the downstream side of the cleaning frame, thereby allowing much waste toner to be received in the cleaning frame compared with a frame body of the same volume. Further, since the partition plate 17 is used, the waste toner received in the cleaning frame 13 never prevents the drive of the waste toner carrying member.

Note that the waste toner is carried to the downstream side of the cleaning frame by rotating the waste toner carrying member used for the cleaning unit C used in the embodiment during the image forming operation. However, the same effect can be obtained even if the waste toner is carried before image formation, during an intermittent operation of the image formation, after the image formation, or according to an instruction from a user.

Alternatively, in the case in which drive sources giving driving forces to the photosensitive drum 7 and the drive member 16*a* are provided separately, or in the case in which a mechanism for mechanically switching a drive mechanism of the same drive source is provided, an effect is achieved regarding the problem of the fluctuation in torque with respect to the photosensitive drum.

(Second Embodiment)

Figure 6:
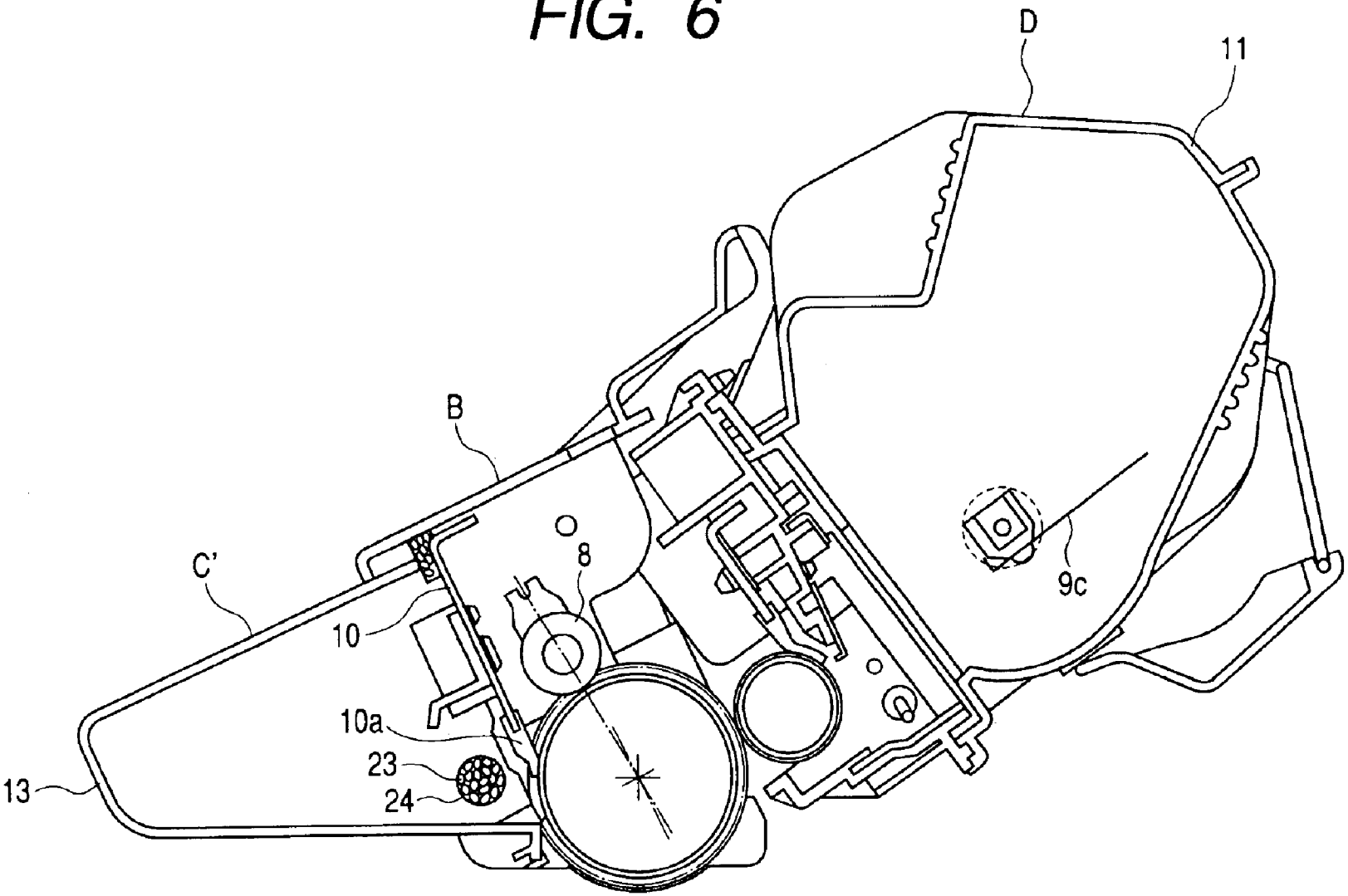
FIG. 6 is a side sectional view showing another embodiment of the process cartridge according to the present invention.
Figure 7:
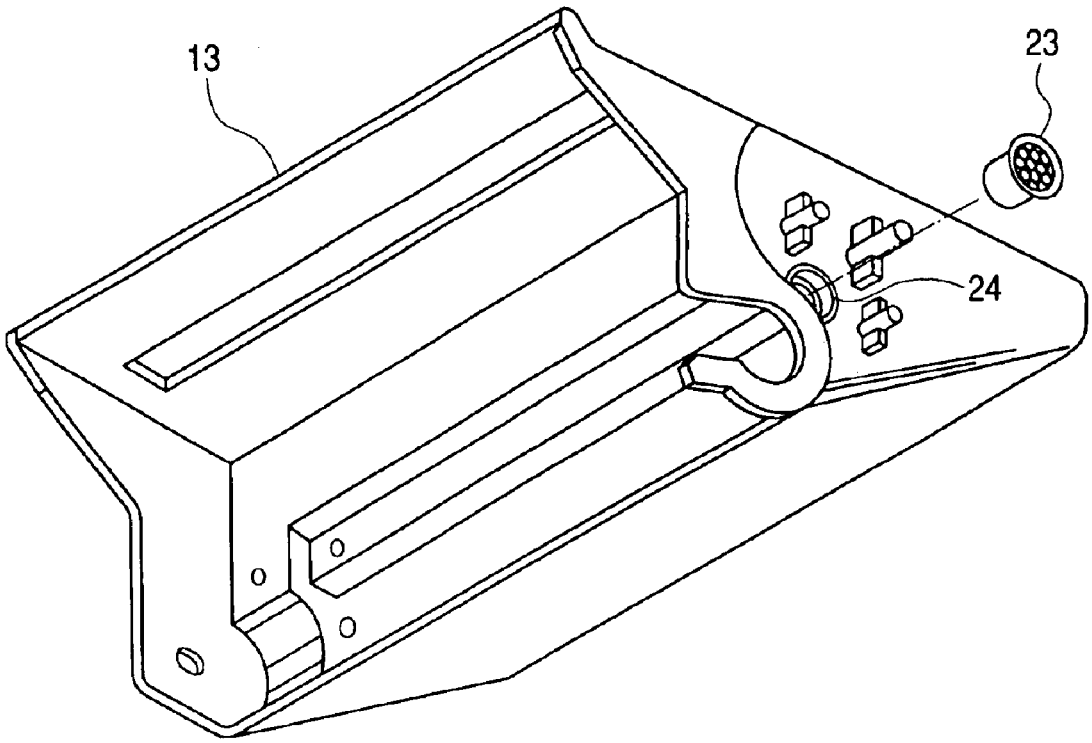
FIG. 7 is a longitudinal sectional view showing through-hole sealing which is used in another embodiment of the process cartridge according to the present invention.

FIGS. 6 and 7 show a process cartridge of a low price and low capacity type using a second cleaning unit C which does not adopt the waste toner carrying member used in the cleaning unit C described in the first embodiment. Note that the same components as those in the first embodiment are denoted by the same reference symbols.

The cleaning unit C' includes the photosensitive drum 7, the cleaning frame 13, the cleaning means 10 including the cleaning blade 10*a*. The cleaning unit C' is rotatably coupled with the development unit D using the coupling member 22, whereby the process cartridge B is constituted.

In the cleaning unit C, the through-hole 24 serving as an opening for mounting a waste toner carrying member is unnecessary because the waste toner carrying member is not adopted. Thus, a toner sealing member 23 is pressed in or welded to the through-hole 24 provided in the cleaning frame 13 to seal the through-hole 24 such that waste toner does not leak therefrom.

Instead of forming the toner sealing member 23 with the same material as the cleaning frame, it is possible to form the toner sealing member 23 with an elastic body in order to make welding work easy.

In addition, the toner sealing member 23 is formed so as to be recessed toward the inside of the cleaning frame 13 from the external circumferential surface thereof, and the drive member 16*a* is received in the central part of the toner sealing member 23. Consequently, it becomes possible to provide a process cartridge which, even in the case in which the drive member 16*a* is provided in the main body of the image forming apparatus, compatibility is improved in mounting and dismounting the cleaning unit C'.

Note that the toner frame 11 described in this embodiment is the same as the toner frame 11 described in the first embodiment. However, since the process cartridge is of a low price and low capacity type, an amount of toner contained in the toner frame 11 is smaller than that in the toner frame 1 of the first embodiment.

Thus, the process cartridge using the cleaning unit C', in which the waste toner carrying member of the cleaning unit C is sealed, has a simplified cleaning unit structure. Therefore, it is possible to provide a process cartridge of a low price.

In addition, since the cleaning frames used in the cleaning units C and C' are the same, sizes of the process cartridge provided with the cleaning unit C and the process cartridge provided with the cleaning unit C' are the same whether the capacity for receiving toner is large or small. Thus, the process cartridges are detachably attachable to the main body of an identical image forming apparatus, respectively. Accordingly, it is sufficient to select one of the process cartridges depending on usage.

In the first and second embodiments, waste toner on the surface of the photosensitive drum 7 is removed. However, the same effect can be obtained even if a cleaning device, which removes waste toner remaining on a surface of not only the photosensitive drum but also a sheet conveyor belt, an intermediate transfer member, or the like, is used as a cartridge.

In addition, the same effect can be obtained even if a cartridge is separately provided from a developer or separately provided from an image bearing member and a developer.

What is claimed is:

1. A process cartridge comprising one of at least a first cartridge of a first type and a second cartridge of a second type, each of which is detachably attachable to a main body of an identical image forming apparatus, wherein said first cartridge comprises:

a cleaning device configured and positioned to remove toner remaining on a surface of a medium;

a cleaning frame configured and positioned to receive toner recovered by said cleaning device and having an opening therein; and a waste toner carrier provided in the opening and configured to carry the toner in said cleaning frame, and wherein said second cartridge comprises:

a cleaning device configured and positioned to remove toner remaining on a surface of a medium;

a cleaning frame configured and positioned to receive toner recovered by said cleaning device and having an opening therein; and a sealing member configured and positioned to seal the opening without said waste toner carrier being provided in the opening.

2. A process cartridge according to claim 1, wherein said cleaning frame used in said first cartridge and said cleaning frame used in said second cartridge are the same shape.

3. A process cartridge according to claim 1, wherein said waste toner carrier of said first cartridge comprises:

a waste toner carrying member which carries waste toner into said cleaning frame of said first cartridge;

a seal member configured and positioned to prevent toner leakage; and a receiving portion configured and positioned to receive a driving force transmitted from the outside of said cleaning frame of said first cartridge for said waste toner carrying member.

4. A process cartridge according to claim 3, wherein said first cartridge further comprises:

a support member configured and positioned to hold said cleaning device of said first cartridge; and a partition member which is supported by said support member and located above said waste toner carrying member, and partitions a part of said cleaning frame of said first cartridge.

5. A process cartridge according to claim 1, wherein said sealing member is composed of resin and seals the opening.

6. A process cartridge according to claim 5, wherein said sealing member is formed of an elastic member.

7. A process cartridge according to claim 1, wherein the opening of said cleaning frame of said second cartridge and said cleaning frame of said second cartridge are adhered to said sealing member by welding.

8. A process cartridge according to claim 1, wherein said sealing member is recessed in a central part thereof.

9. A process cartridge according to claim 1, wherein the medium, from which toner is removed by said cleaning device of said first cartridge, is an image bearing member and is provided in said first cartridge, and wherein the medium, from which toner is removed by said cleaning device of said second cartridge, is an image bearing member and is provided in said second cartridge.

10. A process cartridge comprising one of at least a first cartridge of a first type and a second cartridge of a second type, each of which is detachably attachable to a main body of an identical image forming apparatus, wherein said first cartridge comprises:

an image bearing member;

a toner frame which contains toner to be supplied to said image bearing member;

a cleaning device configured and positioned to remove toner remaining on a surface of said image bearing member;

a cleaning frame configured and positioned to receive toner recovered by said cleaning device and having an opening therein; and a waste toner carrier which is provided in the opening and configured to carry the toner in said cleaning frame, wherein said second cartridge comprises:

an image bearing member;

a toner frame which contains toner to be supplied to said image bearing member of said second cartridge;

a cleaning device configured and positioned to remove toner remaining on a surface of said image bearing member of said second cartridge;

a cleaning frame configured and positioned to receive toner recovered by said cleaning device of said second cartridge and having an opening therein; and a sealing member configured and positioned to seal the opening in said cleaning frame of said second cartridge without said waste toner carrier being provided in the opening of said cleaning frame of said second cartridge, and wherein said toner frame of said first cartridge contains a larger amount of toner than said toner frame of said second cartridge.

11. A process cartridge according to claim 10, wherein said cleaning frame used in said first process cartridge and said cleaning frame used in said second process cartridge are the same shape.

12. A process cartridge according to claim 10, wherein said waste toner carrier of said first cartridge comprises:

a waste toner carrying member configured and positioned to carry waste toner into said cleaning frame of said first cartridge;

a seal member which prevents toner leakage; and a receiving portion configured and positioned to receive a driving force transmitted from the outside of said cleaning frame of said first cartridge for said waste toner carrying member.

13. A process cartridge according to claim 12, wherein said first cartridge further comprises:

a support member which holds said cleaning device of said first cartridge; and a partition member which is supported by said support member and located above said waste toner carrying member, and partitions a part of said cleaning frame of said first cartridge.

14. A process cartridge according to claim 10, wherein said sealing member is composed of resin and seals the opening.

15. A process cartridge according to claim 10, wherein said sealing member is formed of an elastic member.

16. A process cartridge according to claim 15, wherein the opening of said cleaning frame of said second cartridge and said cleaning frame of said second cartridge are adhered to said sealing member by welding.

17. An image forming apparatus according to claim 10, wherein said sealing member is recessed in a central part thereof.

18. An image forming apparatus, comprising:

a process cartridge comprising one of at least a first type cartridge of a first type and a second cartridge of a second type, each of which is detachably attachable to a main body of an identical image forming apparatus, wherein said first cartridge comprises:

a cleaning device configured and positioned to remove toner remaining on a surface of a medium;

a cleaning frame configured and positioned to receive toner recovered by said cleaning device and having an opening therein; and a waste toner carrier which is provided in the opening and carries the toner in said cleaning frame, and wherein said second cartridge comprises:

a cleaning device configured and positioned to remove toner remaining on a surface of a medium;

a cleaning frame configured and positioned to receive toner recovered by said cleaning device of said second cartridge and having an opening therein; and a sealing member configured and positioned to seal the opening of said cleaning frame of said second cartridge without said waste toner carrier being provided in the opening of said cleaning frame of said second cartridge.

19. An image forming apparatus according to claim 18, wherein said cleaning frame used in said first cartridge and said cleaning frame used in said second cartridge are the same shape.

20. An image forming apparatus according to claim 18, wherein said waste toner carrier of said first cartridge comprises:

a waste toner carrying member configured and positioned to carry waste toner into said cleaning frame of said first cartridge;

a seal member configured and positioned to prevent toner leakage; and a receiving portion configured and positioned a driving force transmitted from the outside of said cleaning frame of said first cartridge for said waste toner carrying member.

21. An image forming apparatus according to claim 20, wherein said first cartridge further comprises:

a support member configured and positioned to hold said cleaning device of said first cartridge; and a partition member which is supported by said support member and located above said waste toner carrying member, and partitions a part of said cleaning frame of said first cartridge.

22. An image forming apparatus according to claim 18, wherein said sealing member is composed made of resin and seals the opening.

23. An image forming apparatus according to claim 18, wherein said sealing member is formed of an elastic member.

24. An image forming apparatus according to claim 18, wherein the opening of said cleaning frame of said second cartridge and said cleaning frame of said second cartridge are adhered to said sealing member by welding.

25. An image forming apparatus according to claim 20, wherein said sealing member is recessed in a central part thereof and has a shape for receiving a driving force receiving member which receives a driving force transmitted from said image forming apparatus.

26. An image forming apparatus according to claim 18, wherein said waste toner carrier receives a drive force from a drive source which is the same drive source as that for driving an image bearing member, and wherein the drive source performs switching between driving force transmission means, which drives said waste toner carrier, and driving force transmission means, which drives the image bearing member.

27. An image forming apparatus according to claim 18, wherein said waste toner carrier receives a drive force from a drive source which is separate from a drive source for driving an image bearing member.

28. An image forming apparatus according to claim 18, wherein the medium, from which toner is removed by said cleaning device of said first cartridge, is an image bearing member and is provided in said first cartridge, and the medium, from which toner is removed by said cleaning device of said second cartridge, is an image bearing member and is provided in said second cartridge.

29. An image forming apparatus, comprising:

a process cartridge comprising one of at least a first cartridge of a first type and a second cartridge of a second type, each of which is detachably attachable to a main body of an identical image forming apparatus, wherein said first cartridge comprises:

an image bearing member;

a toner frame which contains toner to be supplied to said image bearing member;

a cleaning device configured and positioned to remove toner remaining on a surface of said image bearing member;

a cleaning frame configured and positioned to receive toner recovered by said cleaning device and having an opening therein; and a waste toner carrier which is provided in the opening and is configured to carry the toner in said cleaning frame, wherein said second cartridge comprises:

an image bearing member;

a toner frame which contains toner to be supplied to said image bearing member of said second cartridge;

a cleaning device configured and positioned to remove toner remaining on a surface of said image bearing member of said second cartridge;

a cleaning frame which receives toner recovered by said cleaning device of said second cartridge and has an opening therein; and a sealing member configured and positioned to seal the opening of said cleaning frame of said second cartridge without said waste toner carrier being provided in the opening of said cleaning frame of said second cartridge, and wherein said toner frame of said first cartridge contains a larger amount of toner than said toner frame of said second cartridge.

30. An image forming apparatus according to claim 29, wherein said cleaning frame used in said first cartridge and said cleaning frame used in said second cartridge are the same shape.

31. An image forming apparatus according to claim 29, wherein said waste toner carrier of said first cartridge comprises:

a waste toner carrying member configured and positioned to carry waste toner into said cleaning frame of said first cartridge;

a seal member configured and positioned to prevent toner leakage; and a receiving portion which receives a driving force from the outside of said cleaning frame of said first cartridge for said waste toner carrying member.

32. An image forming apparatus according to claim 31, wherein said first cartridge further comprises:

a support member which holds said cleaning device of said first cartridge; and a partition member which is supported by said support member and located above said waste toner carrying member, and partitions a part of said cleaning frame of said first cartridge.

33. An image forming apparatus according to claim 29, wherein said sealing member is composed of resin and seals the opening.

34. An image forming apparatus according to claim 29, wherein said sealing member is formed of an elastic member.

35. An image forming apparatus according to claim 29, wherein the opening of said cleaning frame of said second cartridge and said cleaning frame of said second cartridge are adhered to said sealing member by welding.

36. An image forming apparatus according to claim 29, wherein said sealing member is recessed in a central part thereof and has a shape for receiving a driving force receiving member which receives a driving force transmitted from said image forming apparatus.

37. An image forming apparatus according to claim 29, wherein said waste toner carrier receives a drive force from a drive source which is the same drive source as that for driving said image bearing member of said first cartridge, and wherein the drive source performs switching between driving force transmission means, which drives said waste toner carrier, and driving force transmission means, which drives said image bearing member of said first cartridge.

38. An image forming apparatus according to claim 29, wherein said waste toner carrier receives a drive force from a drive source which is separate from a drive source for driving said image bearing member of said first cartridge.

* * * * *

UNITED STATES PATENT AND TRADEMARK OFFICE

CERTIFICATE OF CORRECTION

PATENT NO. : 6,987,938 B2
APPLICATION NO. : 10/743406
DATED : January 17, 2006
INVENTOR(S) : Murakami et al.

It is certified that error appears in the above-identified patent and that said Letters Patent is hereby corrected as shown below:

COLUMN 8:
Line 30, "An image forming apparatus" should read --A process cartridge--.

COLUMN 9:
Line 6, "positioned" should read --positioned to receive--.
Line 19, "made" should be deleted.

Signed and Sealed this

Fifteenth Day of August, 2006

JON W. DUDAS
*Director of the United States Patent and Trademark Office*